US008146488B2

(12) United States Patent
Turrin et al.

(10) Patent No.: US 8,146,488 B2
(45) Date of Patent: Apr. 3, 2012

(54) COOKING OVEN WITH PREMIX BURNER FOR BOILERS

(75) Inventors: Daniele Turrin, Pordenone (IT); Michele Franzoso, Udine (IT)

(73) Assignee: Electrolux Professional SPA, Pordenone (IT)

( * ) Notice: Subject to any disclaimer, the term of this patent is extended or adjusted under 35 U.S.C. 154(b) by 1112 days.

(21) Appl. No.: 12/007,787

(22) Filed: Jan. 15, 2008

(65) Prior Publication Data

US 2008/0190299 A1 Aug. 14, 2008

(30) Foreign Application Priority Data

Feb. 8, 2007 (IT) ..... PN07A0009

(51) Int. Cl.
*A47J 37/07* (2006.01)

(52) U.S. Cl. ..... 99/339

(58) Field of Classification Search ..... 99/339, 99/324, 340, 467, 473, 474; 126/369, 369.3
See application file for complete search history.

(56) References Cited

U.S. PATENT DOCUMENTS

| | | | | |
|---|---|---|---|---|
| 1,336,565 | A * | 4/1920 | Ketler | 99/339 |
| 1,349,529 | A * | 8/1920 | Pattison | 99/339 |
| 1,890,642 | A * | 12/1932 | Edwards | 99/352 |
| 3,605,717 | A * | 9/1971 | Sauer | 126/21 A |
| 3,719,180 | A * | 3/1973 | Pere | 126/21 A |
| 4,128,388 | A * | 12/1978 | Freze | 431/116 |
| 4,512,327 | A * | 4/1985 | Stiegler | 126/21 A |
| 2008/0190299 | A1 * | 8/2008 | Turrin et al. | 99/339 |

FOREIGN PATENT DOCUMENTS

| | | |
|---|---|---|
| CN | 2460871 | 11/2001 |
| DE | 295 00 595.5 | 4/1995 |
| DE | 203 07 161.1 | 9/2003 |
| EP | 1 116 920 | 7/2001 |

OTHER PUBLICATIONS

Office Action issued Apr. 25, 2011 in corresponding Chinese Application No. 200810006794.7.

* cited by examiner

*Primary Examiner* — Mitra Aryanpour
(74) *Attorney, Agent, or Firm* — Wenderoth, Lind & Ponack, L.L.P.

(57) ABSTRACT

A Food cooking oven includes a steam-generation boiler, a gas burner, a fan for generating a forced air flow through and injecting gas into the burner, an outer conduit branching out from the burner and adapted to convey the flue gases through the boiler. The gas burner includes a first inner, preferably cylindrically shaped body and a second outer body that is in direct communication with the outer conduit and accommodates the first inner body so as to form a pre-mixing region in the hollow gap created therebetween. The outer surface of the first inner body is provided with a plurality of first apertures, which are distributed all over the outer surface, and the surface of the second outer body is provided with a plurality of respective second apertures, which are preferably provided to cover just a single, delimited portion of the respective outer surface and are in direct communication with the outer conduit.

20 Claims, 8 Drawing Sheets

COOKING OVEN WITH PREMIX BURNER FOR BOILERS

BACKGROUND OF THE INVENTION

I. Field of the Invention

The present invention refers to an improved kind of oven for cooking food, comprising a boiler provided to generate steam.

II. Description of the Related Art

Largely known in the art there are ovens, which are adapted to steam food, i.e. cook food by steaming, and which—further to being capable of cooking food by any of a number of traditional methods, and being provided with appropriate cooking devices and arrangements, accordingly—are adapted to also enable food to undergo a particular cooking mode by letting a flow of steam into the cooking cavity to saturate the interior thereof.

The basic features and characteristics of such ovens are extensively described, for example, in the German patent application no. 20307161.1, filed by this same Applicant, to which reference should therefore be made for greater convenience and brevity.

Ovens of this kind are also disclosed in great detail also in other publications, such as European patent EP 1 116 920 A2 and German utility model DE-GM 295 00 595.5.

The solutions that have been disclosed up to this moment generally show that—substantially—each gas burner provided to ensure heating of a respective steam generating boiler, is a means that is exactly sized to just cope with the intended use thereof. In other words, the members and parts used to govern or adjust such operating parameters as gas inflow and throughflow, fan flow-rate, and the like, and—above all—the size of the burner body are in all cases optimized just in view of complying with the requirements associated with a given, particular application, which the burner itself is intended for, so that they cannot be generally used in connection with steam-generating boilers of cooking ovens having even slightly different characteristics and boiler ratings.

This practically forces manufacturers involved in the production of this kind of cooking ovens into designing and manufacturing a really wide variety of boilers and—above all—related gas burner bodies. Now, it can be most readily appreciated that this necessity for such splitting-up effect to be introduced in both design and production processes does of course not fail to bring about obviously and considerably higher costs deriving from a poorer than desired production standardization, i.e. a circumstance that is quite familiar to all those skilled in the art, so that it certainly does not need any further explanation.

SUMMARY OF THE INVENTION

It would therefore be desirable, and it is actually a main purpose of the present invention, to provide a gas burner of the so-called premix kind, which is adapted to ensure heat outputs that are adjustable within a really wide range by adjusting burner-related variables that are not associated to or do not depend on the sizing of the same burner; accordingly, a single type of premix gas burner according to the present invention will be capable of being used in a wide variety of different oven models having respective different boiler ratings, without introducing or putting any appreciable penalty on the actual performance capabilities of any of such various oven types and models.

According to the present invention, these aims, along with further ones that will become apparent from the following disclosure, are reached in a kind of premix gas burner used to heat up steam-generating boilers in food cooking oven, as particularly intended for food service and mass-catering applications that incorporates the features and characteristics as defined and recited in the appended claims.

BRIEF DESCRIPTION OF THE DRAWINGS

Advantages and features of the present invention will anyway be more readily understood from the description that is given below by way of non-limiting example with reference to the accompanying drawings, in which.

DETAILED DESCRIPTION OF THE INVENTION

Figure 1:
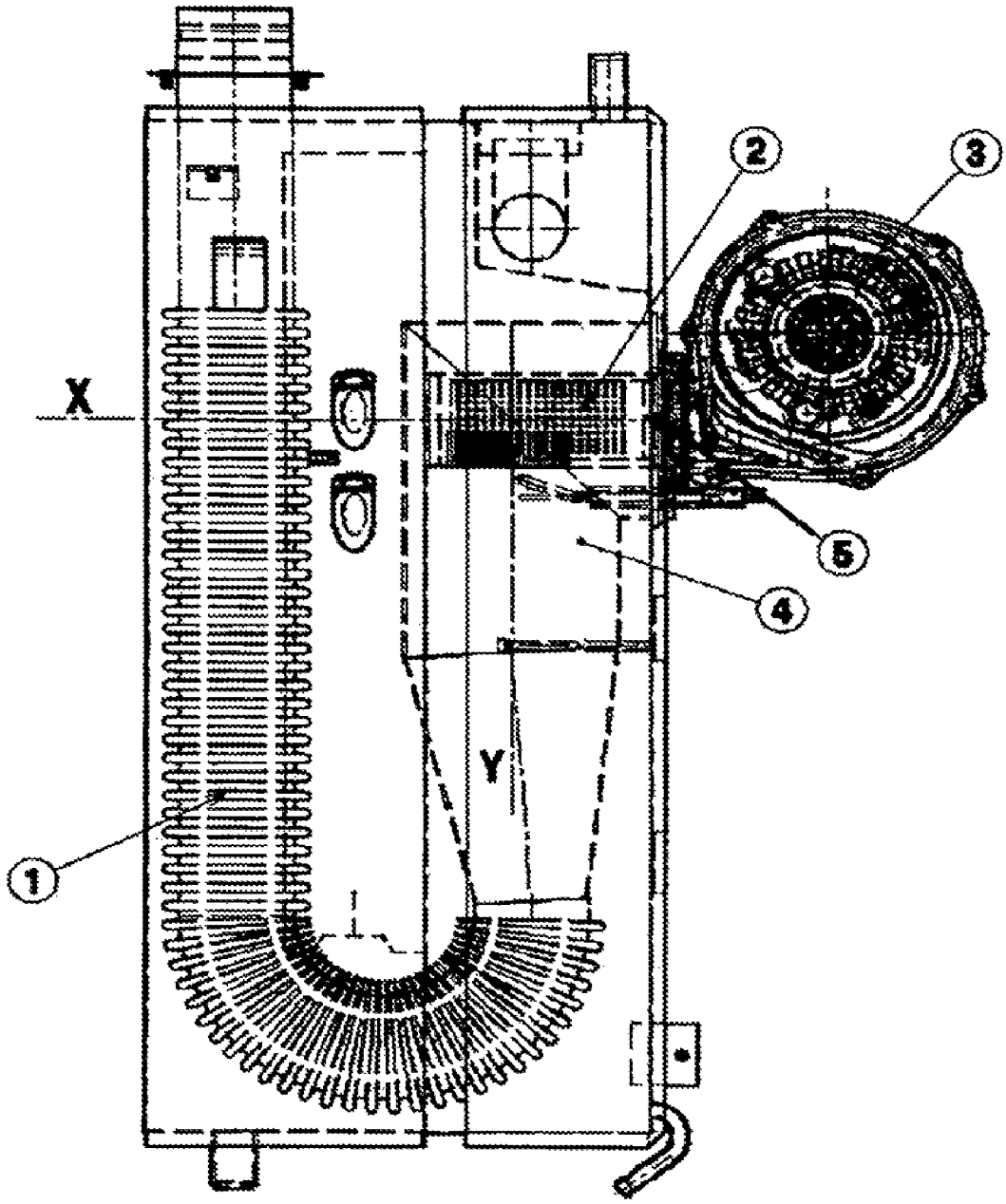
FIG. 1 PRIOR ART
FIGS. 1 and 1A are a vertical planar-projection see-though view and a perspective view, respectively, showing schematically a premix gas burner according to the present invention and the positioning thereof relative to the boiler being associated therewith.

The present invention is essentially based on following considerations: since the main object lies in providing a kind of gas burner, which is potentially adapted to ensure heat outputs that may differ from each other even to a quite considerable extent, and in which, such widely varying heat outputs shall be adjustable by correspondingly controlling variables other than the size of the burner, the solution that has been searched for and found in this connection is based on defining some features of the burner that are effective in enhancing the efficiency thereof, while preferably reducing the space requirements, i.e. increasing the compactness thereof.

However, this aim can only be reached if combustion of the gas directly at the outflow port of the gas injector is avoided, while providing an intermediate pre-mixing region between the flame region and the injector outflow port.

It has in fact been found that, by providing such pre-mixing region upstream to, i.e. before the flame region, the gas jet is allowed to optimally pre-mix with the primary air being blown jointly with the same gas jet.

As a direct consequence thereof, such improved pre-mixing of the gas with the primary air has the effect of ensuring an optimum combustion of the same gas, resulting in a significant overall increase in the efficiency of the burner, all other functional and design characteristics of the burner remaining of course unaltered.

An oven for cooking food by steam according to the prior art (FIG. 1) comprises:

a steam-generation boiler 1, a gas burner 2, a fan 3 for generating a flow of forced air through said burner, an outer conduit 4 branching out from said burner and adapted to convey the flue gases produced by said burner, and issuing therefrom, through said boiler.

Furthermore, one or more gas injectors 5 are associated to said fan 3 and the related delivery conduit, so as to be able to inject respective flows of fuel gas into the flow of air being blown by said fan 3 into said burner 2. Anyway, this technique is largely known as such in the art, so that it shall not be dealt with and illustrated any longer.

According to the prior art, such a gas burner is generally made to only comprise a single, almost totally sealed body, into which there is let a flow of gas mixed with primary air; this mixed air/gas flow exits the almost totally sealed body of the burner by passing through a number of perforations, or ports, provided in the surface of the same burner body, to be then ignited and burned just at the aperture of each such port, on the outside thereof.

In a totally different manner, the gas burner according to the present invention (FIGS. 4 and 5) does not consist of a single, isolated body, but is rather comprised of an assembly formed of a first inner, preferably cylindrically shaped body 6, and a second outer body 7 that is made and arranged so as to accommodate said first inner body 6.

Figure 4:
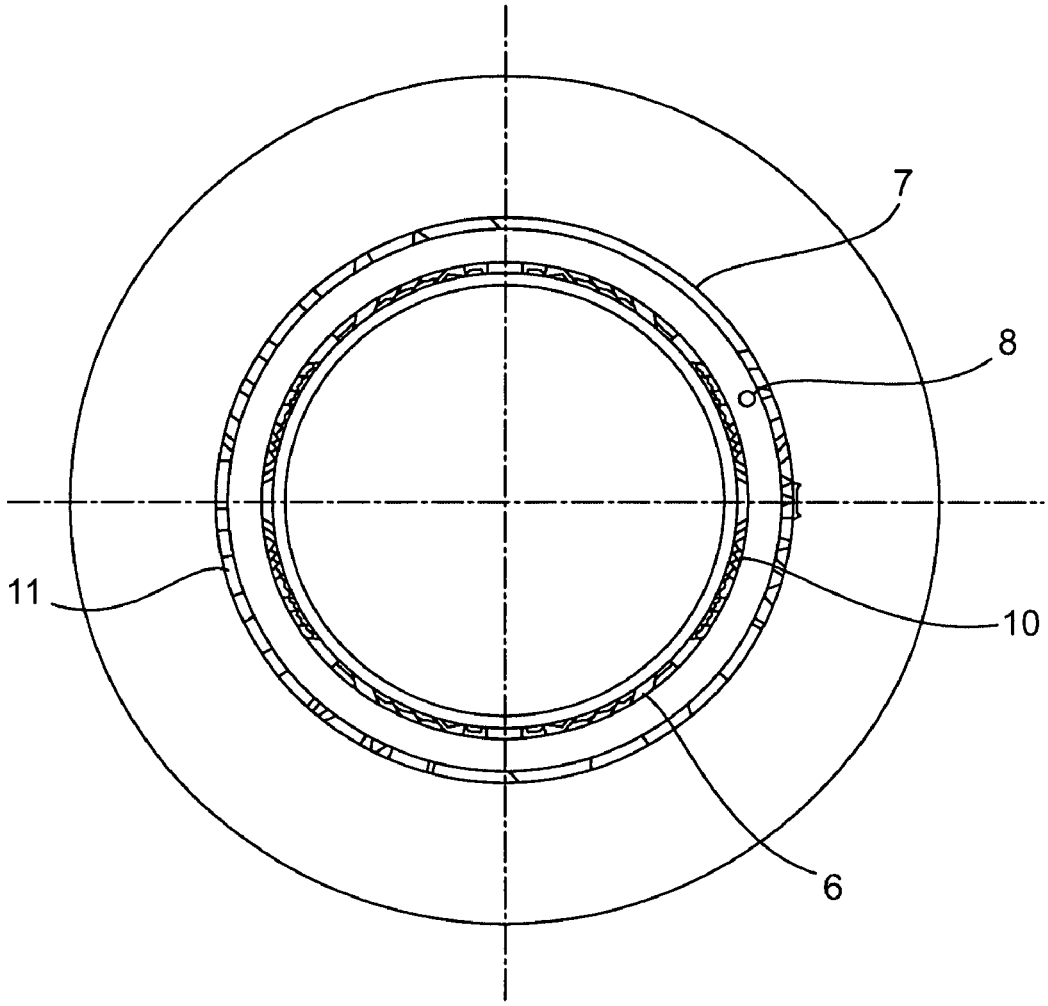
FIG. 4 is a planar sectional view of the cylindrical burner shown in FIG. 2, as viewed along a section plane extending orthogonally to the axis of the same burner.

Said two bodies 6 and 7 are further arranged so as to be physically separated from each other, thereby forming a premixing region 8 in the hollow gap so created and existing therebetween (FIG. 4).

In addition, said second outer body 7 is in turn accommodated inside the initial portion of the outer flue conduit (FIG. 5), so that the hot flue gases discharged from said second outer body 7 are able to be fully and naturally let into said outer flue conduit 4, from which they are then conveyed into said boiler 1. This shall be explained in greater detail further on (FIG. 5).

Figure 5:
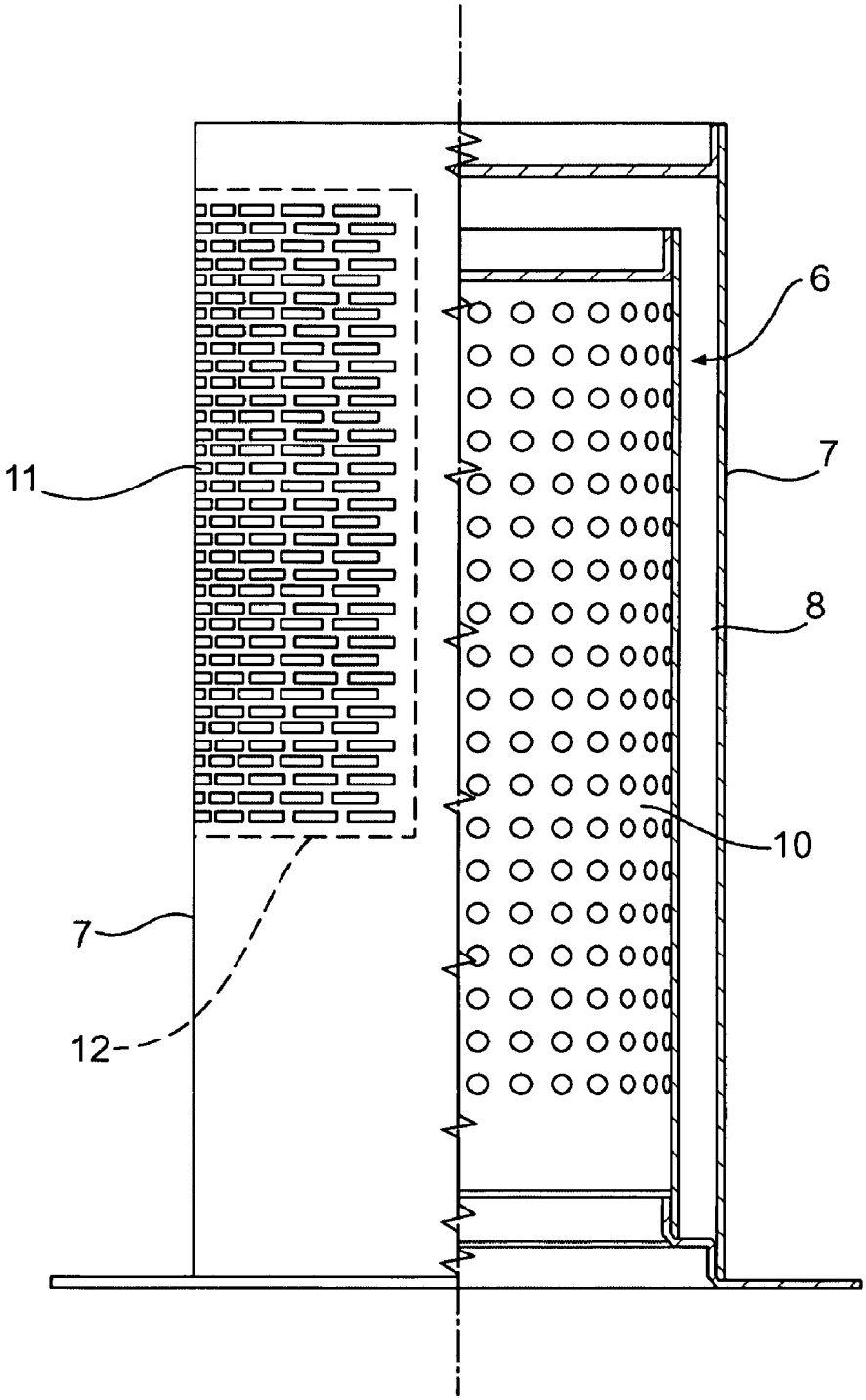
FIG. 5 is a similar view of the one appearing in FIG. 3, wherein the outer surface of the burner, however, is partially sectioned in this case.
Figure 6A:
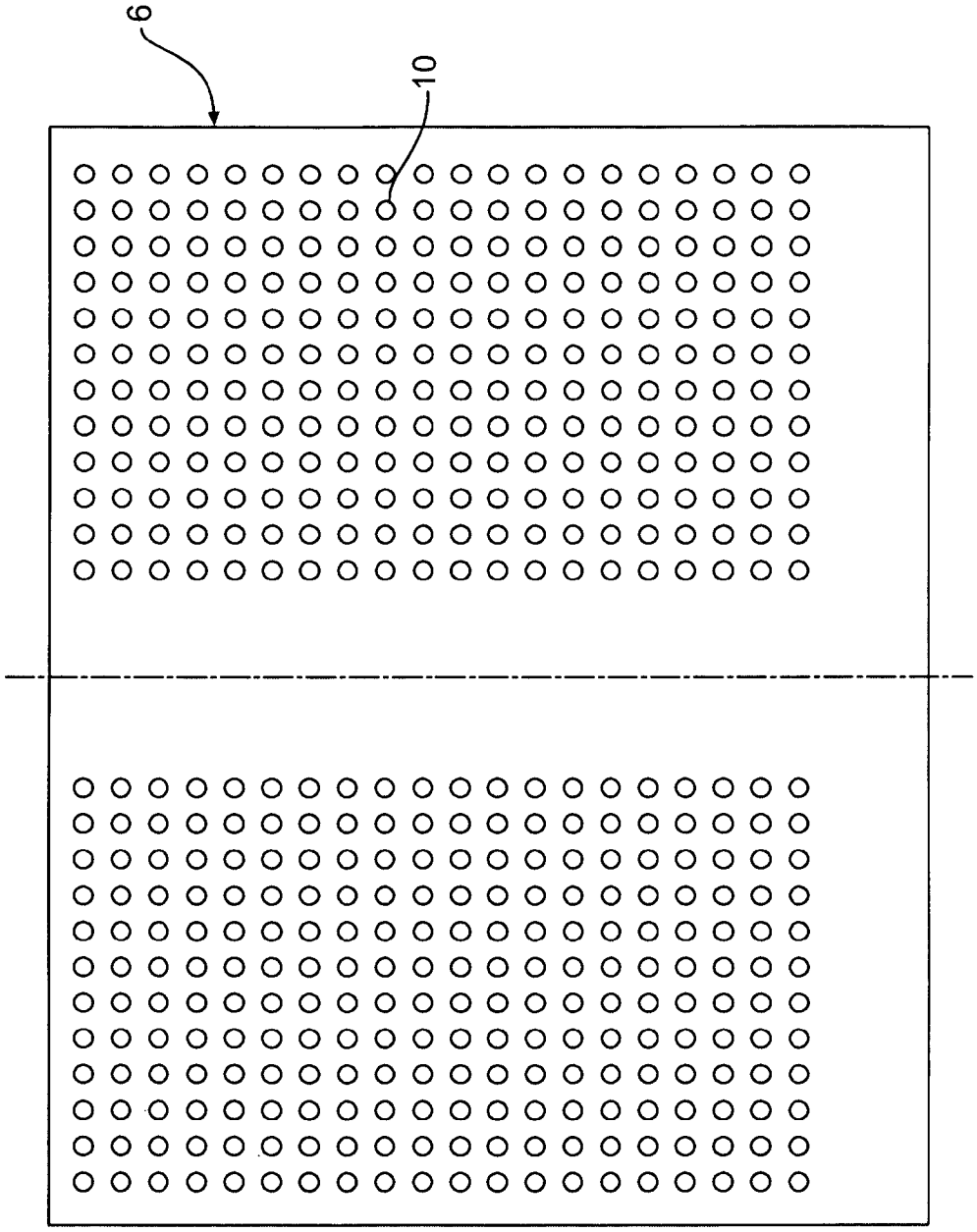
FIGS. 6A and 6B are symbolical views of the spread-out development along respective planes of the two respective cylindrical surfaces of the two component parts of the burner according to the present invention.
Figure 6B:
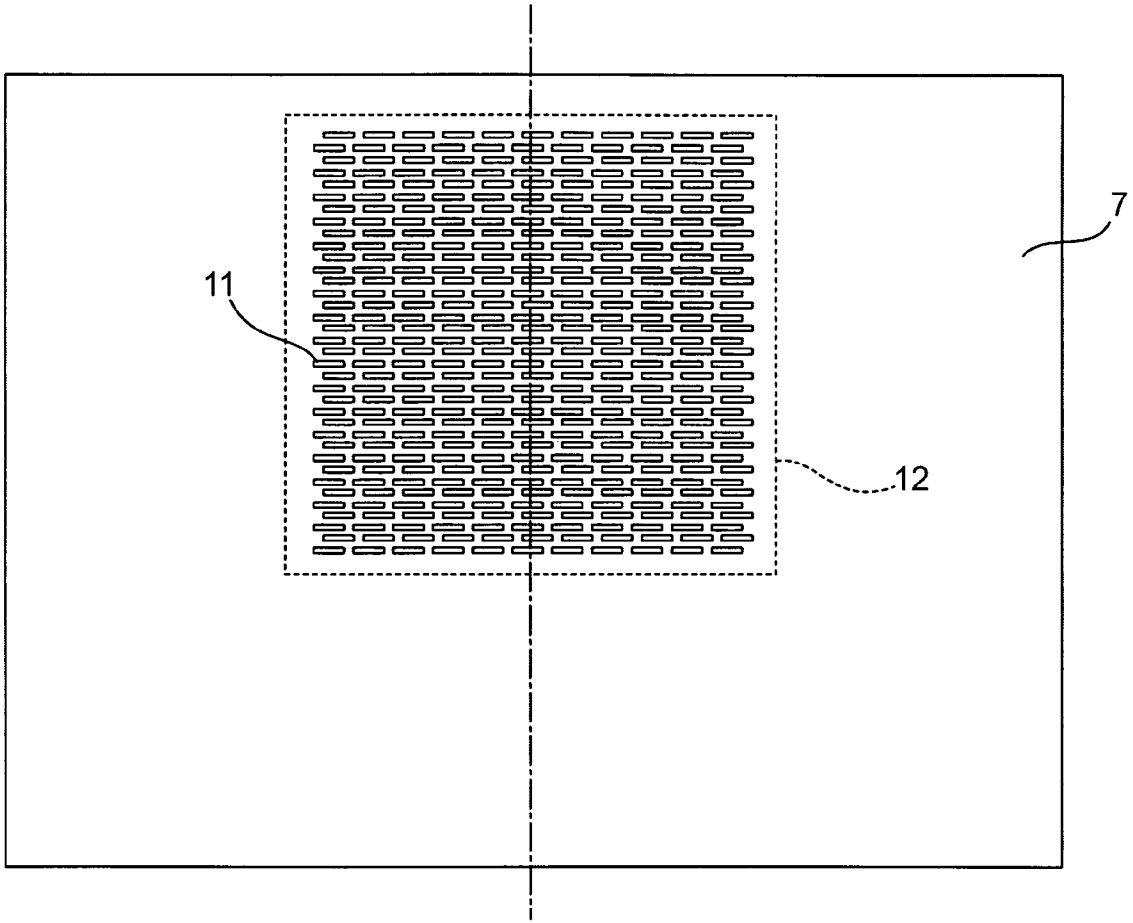

With particular reference to FIG. 5, as well as FIGS. 6A and 6B, the surface of the first inner body 6 is provided with a plurality of first apertures 10, which are evenly and regularly distributed all over the cylindrical side side surface of said body, whereas said second outer body 7 is provided with a plurality of second apertures 11, which are similar to said first apertures 10, except for the fact that—as opposed to said first apertures 10—these second apertures 11 are solely provided to cover just a single side portion 12 of the related second outer body 7.

A gas burner is in this way provided, in which the combustion air—as mixed with the gas being injected by the injectors 5—is let into the first inner body 6 to leave it through said first apertures 10 thereof. As mentioned above, in the following hollow gap existing between said two burner bodies there forms a premixing field that is effective in exalting air and gas mixing to quite remarkable an extent. The thus formed mixture is in turn ejected through the second apertures 11 provided in the surface of the second outer body 7, where it then burns.

Owing to the high efficiency, reached thanks to said full and thorough pre-mixing effect, it has been found that—normally—it is not necessary for all said second apertures 11 to be distributed all over the entire surface of the second outer body 7, since providing said apertures so as to solely cover a limited portion 12 of said surface proves fully adequate, actually.

More precisely, if the cylindrical side surface of the outer body 7 is developed, i.e. unfolded onto a plane, as this is shown in FIG. 6B, said portion 12, in which said second apertures 11 are provided, can be noticed to define a rectangle or a square.

Figure 1A:
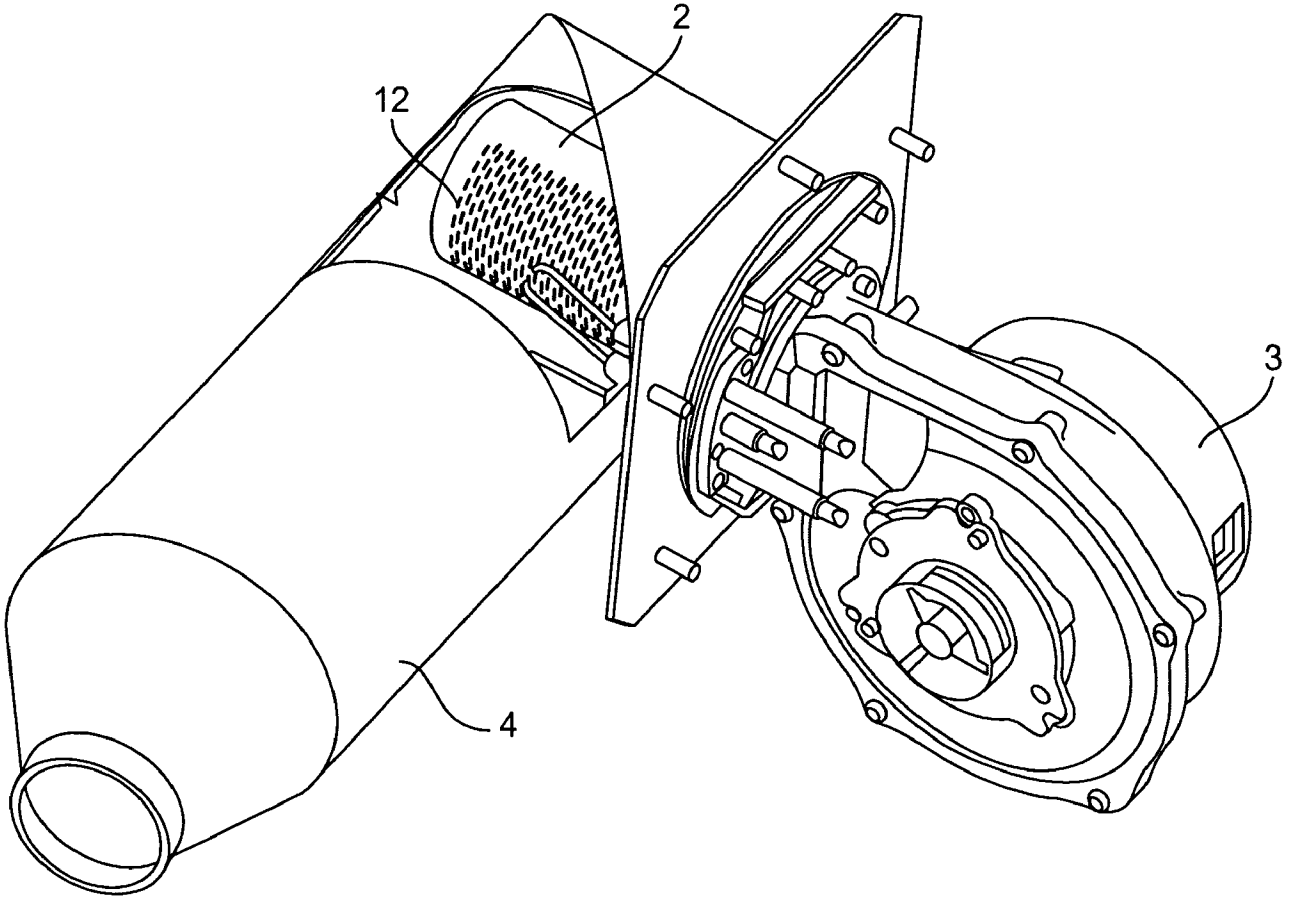
Figure 2:
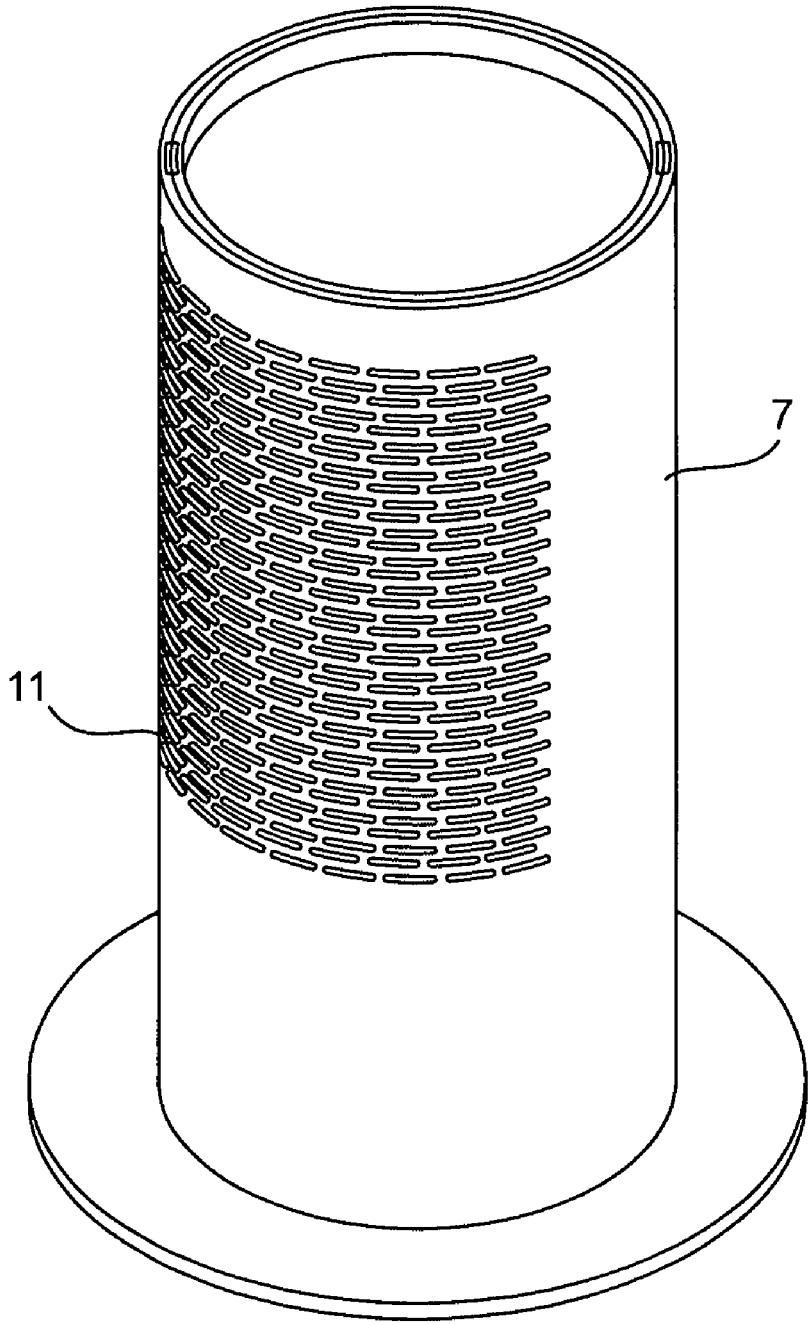
FIG. 2 is a simplified perspective view of the burner shown in FIG. 1, as viewed from the outside.
Figure 3:
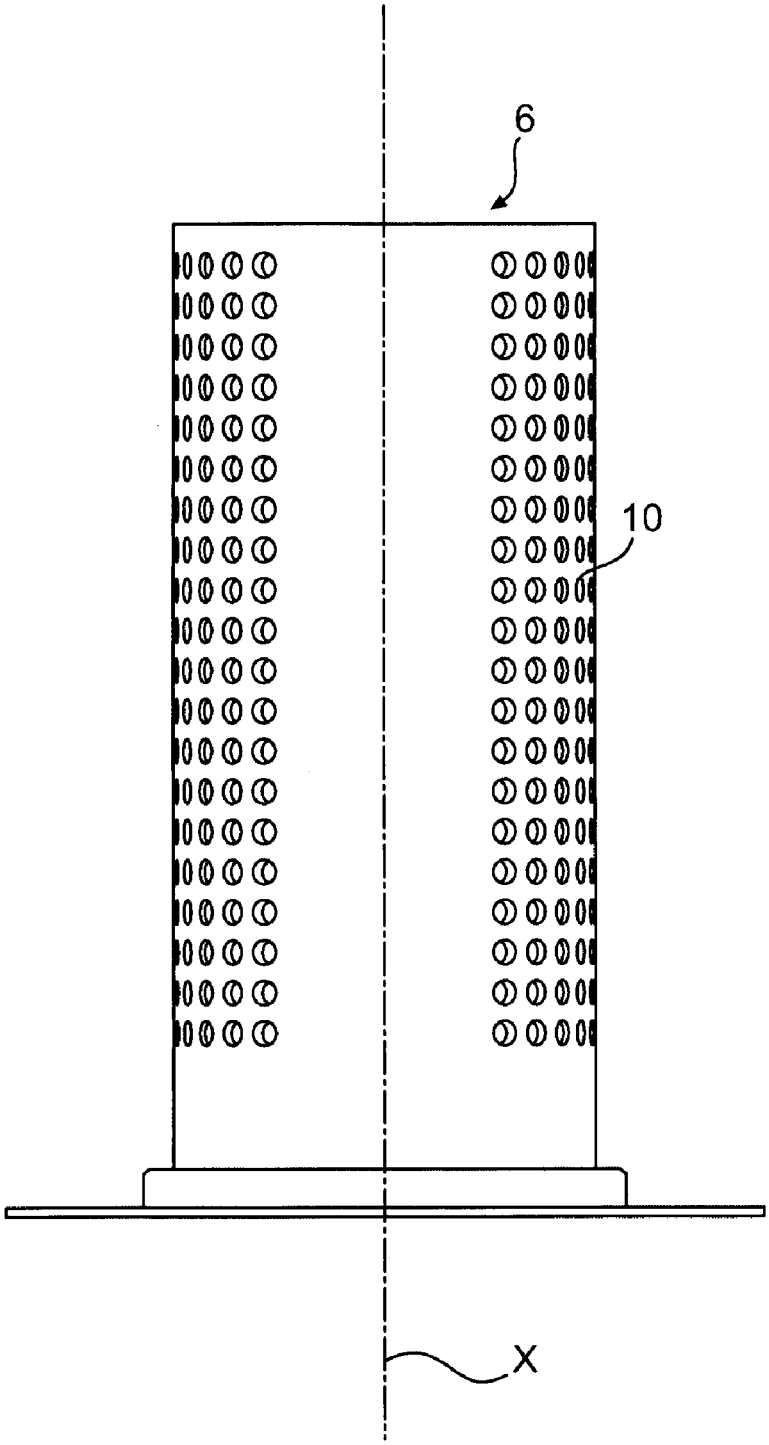
FIG. 3 is a planar front view of an inner component part of the cylindrical burner shown in FIG. 2.

It is further advantageous when said portion 12 is so arranged as to directly face said boiler 1 in the direction followed by the flue gases flowing towards it. To this purpose, said assembly comprised of said two bodies 6 and 7 is mounted with the axis X thereof lying orthogonally to the axis Y of the flow direction of the flue gases in said outer flue conduit 4 (FIGS. 1 and 1A).

It is in this case particularly advantageous when said perforated portion 12 is in a way or another arranged so as to be entirely facing said outer conduit in the conveyance or flow direction Y of the flue gases and—to such purpose—an improved embodiment of the present invention is based on forming said second outer body 7 so that the section of said delimited portion 12 on a plane lying orthogonal to the axis X of said second outer body 7 develops by an angle that is not greater than 180° (FIG. 4).

In an advantageous manner, said delimited portion 12 is so arranged and oriented on said second outer body 7 as to be fully, or at least prevailingly, facing the inner volume of said outer flue conduit 4, so that combustion of the air/gas mixture is able to directly occur right at the initial side of the flow-path along which the flue gases are conveyed towards said steam-generating boiler 1; this solution, in fact, proves effective in favouring an advantageously quick transfer of the hot flue gases into the steam-generating boiler 1, thereby improving the ultimate energy efficiency of the boiler to a still further extent.

Said two inner and outer burner bodies 6 and 7 can on the other hand be most easily provided with the use of readily available manufacturing techniques and materials. In this connection, it should be merely noticed that, as opposed to prior-art burners of this kind, in which the combustion surface of the burners is generally provided by a wire gauze or similar finely or thickly meshed metal kind of mantle, the two burner bodies 6 and 7 according to the present invention are preferably manufactured by a process involving a couple of distinct steps, in which:

an appropriate pattern of appropriately sized perforations is first of all created in respective metal blanks using traditional techniques, and then said two perforated metal blanks are calendered, so as to level and round them to an appropriate respective diameter.

From an industrial engineering point of view, such kind of manufacturing process may certainly be considered as a considerably simple, quick and—above all—low-cost one; however, it may have a kind of technologically conditioned impairing limitation in that calendering is a process that cannot be used, i.e. is not practicable when diameters are to be obtained, which are smaller than a given value.

It has in fact been found that—in view of overcoming such technologically determined limitation of the calendering process—the optimum diameter size to be selected for the above-cited first inner body 6 should be set at a value in excess of 40 mm (1.57 in).

It has on the other hand also been found that, notwithstanding such a technological restraint, pairs of inner-outer bodies having respective diameters can nevertheless be made, which, although being confined; i.e. delimited as far as the minimum size thereof is concerned—are still capable of ensuring sufficiently low heat output rates for the requirements arising from a combination thereof with even lowest-rated boilers to be adequately complied with, while, when appropriately supplied with suitable air/gas mixtures at adequate flow rates, and thanks to the remarkably high efficiency thereof, they are also capable of ensuring heat output rates coping with the requirements of boilers used in connection with ovens requiring high boiler ratings.

According to the present invention, therefore, a single type of burner is substantially provided, which combines a number of excellent properties ensuring a most desirable flexibility in the application and operation thereof, since

- it is capable of being used to cope with heat-output requirements varying within a very wide range,
- it is capable of being manufactured using highly industrialized, i.e. automated, inherently very simple, reliable and—particularly cost-effective manufacturing techniques,
- it has quite compact an overall outer size, which is in all cases a much—desired and highly valued factor in all kinds of home and similar appliances,
- it anyway and in all cases ensures top-ranking energy-efficiency performance in all kinds of uses thereof, thanks to its capability of having both gas and air premixed to a really optimum extent well in advance of them reaching the combustion site.

The invention claimed is:

1. A food cooking oven for use in commercial foodservice and mass-catering applications, provided with a steam generator, said food cooking oven comprising:

- a boiler;
- a gas burner configured to burn an air/gas mixture;
- a fan configured to generate a forced air flow and blow the forced air flow into said burner via a delivery conduit;
- a gas injector associated with said delivery conduit, and being configured to inject gas into the forced air flow;
- an outer conduit branching out from said burner and configured to convey through said boiler flue gases produced by and issuing from said gas burner;
- wherein said gas burner comprises:
- an assembly having a first inner, cylindrically shaped body, arranged to receive the forced air flow mixed with the injected gas, and a second outer body configured and arranged so as to accommodate said first inner body therewithin and having a surface configured to burn the air/gas mixture, a pre-mixing region disposed in a hollow gap created between said first inner body and said second outer body to exalt mixing of the forced air flow with the injected gas so as to form the air/gas mixture to be burned.

2. A food cooking oven according to claim 1, wherein said second outer body is at least partially in communication directly with said outer conduit.

3. A food cooking oven according to claim 2, wherein an outer surface of said first inner body has a plurality of first apertures, which are evenly and regularly distributed substantially over said outer surface, and said second outer body has a plurality of respective second apertures.

4. A food cooking oven according to claim 3, wherein said second apertures are solely provided to cover just a single, delimited portion of said outer surface of said second outer body, and said outer conduit is directly in communication with said second apertures.

5. A food cooking oven according to claim 1, wherein said burner assembly is arranged so as to cause said second apertures to be sited on said surface of said second body so as to be substantially oriented towards the flue-gas conveyance axis of said outer conduit.

6. A food cooking oven according to claim 4, wherein said delimited portion, in which said second apertures are provided, defines a rectangle or a square when developed.

7. A food cooking oven according to claim 1, wherein said second outer body is a cylinder, and a section of a delimited portion on a plane lying orthogonal to the axis of said cylinder, develops by an angle that is not greater than 180° C.

8. A food cooking oven according to claim 1, wherein said fan and said gas injector are so configured and arranged as to be capable of letting forced air and gas, respectively, into said first inner body.

9. A food cooking oven according to claim 1, wherein the diameter of said first inner body is greater than 40 mm.

10. A food cooking oven according to claim 2, wherein said burner assembly is arranged so as to cause said second apertures to be sited on said surface of said second body so as to be substantially oriented towards the flue-gas conveyance axis of said outer conduit.

11. A food cooking oven according to claim 3, wherein said burner assembly is arranged so as to cause said second apertures to be sited on said surface of said second body so as to be substantially oriented towards the flue-gas conveyance axis of said outer conduit.

12. A food cooking oven according to claim 4, wherein said burner assembly is arranged so as to cause said second apertures to be sited on said surface of said second body so as to be substantially oriented towards the flue-gas conveyance axis of said outer conduit.

13. A food cooking oven according to claim 5, wherein a delimited portion, in which said second apertures are provided, defines a rectangle or a square when developed.

14. A food cooking oven according to claim 2, wherein said second outer body is a cylinder, and a section of a delimited portion on a plane lying orthogonal to the axis of said cylinder, develops by an angle that is not greater than 180° C.

15. A food cooking oven according to claim 3, wherein said second outer body is a cylinder, and a section of a delimited portion on a plane lying orthogonal to the axis of said cylinder, develops by an angle that is not greater than 180° C.

16. A food cooking oven according to claim 4, wherein said second outer body is a cylinder, and a section of said delimited portion on a plane lying orthogonal to the axis of said cylinder, develops by an angle that is not greater than 180° C.

17. A food cooking oven according to claim 5, wherein said second outer body is a cylinder, and a section of a delimited portion on a plane lying orthogonal to the axis of said cylinder, develops by an angle that is not greater than 180° C.

18. A food cooking oven according to claim 6, wherein said second outer body is a cylinder, and a section of a delimited portion on a plane lying orthogonal to the axis of said cylinder, develops by an angle that is not greater than 180° C.

19. A food cooking oven according to claim 2, wherein said fan and said gas injector are so configured and arranged as to be capable of letting forced air and gas, respectively, into said first inner body.

20. A food cooking oven according to claim 3, wherein said fan and said gas injector are so configured and arranged as to be capable of letting forced air and gas, respectively, into said first inner body.

* * * * *